US007818899B2

(12) United States Patent
Dinndorf et al.

(10) Patent No.: US 7,818,899 B2
(45) Date of Patent: Oct. 26, 2010

(54) FOOTWEAR TENSIONING SYSTEM

(75) Inventors: Mark Dinndorf, Edina, MN (US); Jack Pflueger, Pacifica, CA (US)

(73) Assignee: Red Wing Shoe Company, Inc., Red Wing, MN (US)

( * ) Notice: Subject to any disclaimer, the term of this patent is extended or adjusted under 35 U.S.C. 154(b) by 256 days.

(21) Appl. No.: 11/324,148

(22) Filed: Dec. 30, 2005

(65) Prior Publication Data

US 2006/0191164 A1 Aug. 31, 2006

Related U.S. Application Data

(60) Provisional application No. 60/641,529, filed on Jan. 5, 2005.

(51) Int. Cl.
*A43B 7/14* (2006.01)

(52) U.S. Cl. ..... 36/88; 36/7.3; 36/4

(58) Field of Classification Search ..... 36/88, 36/50.1, 117.6, 117.7, 117.9, 118.1, 4, 7.3
See application file for complete search history.

(56) References Cited

U.S. PATENT DOCUMENTS

| | | | | | |
|---|---|---|---|---|---|
| 3,235,981 | A | | 2/1966 | Kloss | |
| 4,408,403 | A | | 10/1983 | Martin | |
| 4,539,763 | A | | 9/1985 | Walkhoff | |
| 4,583,306 | A | * | 4/1986 | Paris | 36/118.1 |
| 4,593,483 | A | * | 6/1986 | Paris | 36/118.1 |
| 4,620,378 | A | * | 11/1986 | Sartor | 36/117.8 |
| 4,660,303 | A | * | 4/1987 | Courvoisier et al. | 36/117.9 |
| 4,757,621 | A | * | 7/1988 | Iwama | 36/117.8 |
| 4,785,555 | A | * | 11/1988 | Sartor | 36/117.8 |
| 4,802,291 | A | * | 2/1989 | Sartor | 36/118.1 |
| 4,811,502 | A | | 3/1989 | Barret | |
| 4,811,503 | A | | 3/1989 | Iwama | |
| 4,922,634 | A | * | 5/1990 | Seidel | 36/117.8 |
| 4,937,953 | A | * | 7/1990 | Walkhoff | 36/118.1 |
| 4,942,680 | A | | 7/1990 | Benetti | |
| 4,984,375 | A | * | 1/1991 | Bonnet | 36/117.8 |
| 5,001,851 | A | * | 3/1991 | Baggio et al. | 36/117.9 |
| 5,065,533 | A | * | 11/1991 | Paris | 36/118.1 |
| 5,313,720 | A | * | 5/1994 | De Bortoli et al. | 36/117.8 |
| D386,293 | S | | 11/1997 | Brooks et al. | |
| 5,738,937 | A | * | 4/1998 | Baychar | 428/316.6 |
| 5,913,592 | A | | 6/1999 | Moore | |

(Continued)

FOREIGN PATENT DOCUMENTS

| | | |
|---|---|---|
| IT | 1 691 109 | 5/1987 |

*Primary Examiner*—Marie Patterson
(74) *Attorney, Agent, or Firm*—Merchant & Gould P.C.

(57) ABSTRACT

A footwear includes an outer member, an inner lining, an instep member, and a lace. The outer member defines an outer surface of the footwear. The inner lining is positioned within the outer member. The instep member extends across an instep portion of the inner lining. The instep member can be positioned between the outer member and the inner lining or embedded within the inner lining. The lace is coupled to the instep member and to the outer member. Applying a tension force to the lace causes the instep member to apply a force against the instep portion of the inner lining, thereby applying an instep force against an instep portion of a user's foot that is positioned in the footwear. The instep force against the user's foot holds the user's foot against a bottom and rear portion of the footwear.

14 Claims, 7 Drawing Sheets

U.S. PATENT DOCUMENTS 6,048,810 A * 4/2000 Baychar ..... 442/370
6,226,898 B1 * 5/2001 Trimble et al. ..... 36/118.2
6,267,390 B1 7/2001 Maravetz et al.
6,367,166 B1 * 4/2002 Barthelemy et al. ..... 36/3 R
6,378,230 B1 * 4/2002 Rotem et al. ..... 36/50.1
6,442,873 B2 * 9/2002 Rork et al. ..... 36/88
6,467,194 B1 * 10/2002 Johnson ..... 36/50.1
6,467,195 B2 10/2002 Pierre et al.
6,792,702 B2 9/2004 Borsoi et al.
6,896,128 B1 * 5/2005 Johnson ..... 36/50.1
2001/0007178 A1 7/2001 Pierre et al.
2001/0025437 A1 10/2001 Rork et al.
2002/0002781 A1 1/2002 Bouvier
2003/0029058 A1 * 2/2003 Lin ..... 36/55
2004/0074110 A1 4/2004 Borsoi
2005/0210706 A1 * 9/2005 Johnson ..... 36/50.1
2007/0186447 A1 * 8/2007 Ramos ..... 36/50.1
2007/0240334 A1 * 10/2007 Johnson ..... 36/50.1

* cited by examiner

FOOTWEAR TENSIONING SYSTEM

CROSS REFERENCE TO RELATED APPLICATIONS

This application claims priority to U.S. Provisional Application Ser. No. 60/641,529 filed on Jan. 5, 2005, and entitled KNEE BOOT TENSIONING SYSTEM, the disclosure of which is incorporated herein by reference in its entirety.

BACKGROUND

1. Technical Field

The present invention generally relates to footwear, and more particularly relates to tensioning systems for footwear.

2. Related Art

Knee boots and other types of slip-on footwear that are used for, for example, outdoor applications such as hunting and the like are usually larger than the foot to make it easy to slip on the footwear. However, the larger size of the footwear also makes it easier for the foot to slip out of the boot or to generally be uncomfortable during use, such as while hiking through difficult terrain. Slip-on footwear typically do not include straps, fasteners, laces or other types of tightening devices positioned on an exterior of a slip-on footwear that tighten the footwear against the user's foot, because those types of tightening systems detract from the slip-on appeal of the footwear. Some types of slip-on footwear are capable of opening wider at a top for insertion of the user's foot, then can be closed to a single closed size using, for example, a zipper, Velcro closer, etc. However, the single closed size does not always provide the desired amount of tensioning and support for the user's foot.

A footwear or footwear feature that addresses these and other shortcomings in footwear would be an advance in the art.

SUMMARY

The present invention relates to an apparatus for tightening a footwear around a user's foot. The invention more particularly relates to a system that includes an instep member positioned over the instep of the user's foot that can be tightened against the instep to urge the foot rearward and downward in the footwear. The system includes laces that extend downward from the instep member to an anchor point and then upward towards the upper portion of the footwear. The laces can be pulled upward from the anchor point to tighten the instep member downward against the user's instep. The laces can be locked in the tightened position and can be released to allow the user to more easily remove their foot from the footwear.

One aspect of the invention provides a tensioning system for a slip-on or other type of footwear that can easily be released to permit the foot to slip into the boot. The present invention utilizes an instep member positioned inside the footwear over the instep of the foot. The instep member is connected at its ends to a lace that extends through oppositely disposed anchors that are positioned along a bottom edge of the footwear. The laces extend from the anchors upwardly into an upper portion of the footwear where a lock is used to lock the lace sections in a tightened position or release the laces to permit removal of the user's foot. The footwear may include a cloth lining that covers the foot. The tensioning system is located between the cloth lining and an outer material of the footwear. When the tensioning system is released, the foot can be slipped into or out of the boot. When the tensioning system is tightened to a degree that is comfortable to the wearer, the system adds desired stability to the footwear.

Another aspect of the invention relates to a footwear that includes an outer member, an inner lining, an instep member, and a lace. The outer member defines an outer surface of the footwear. The inner lining is positioned within the outer member. The instep member is positioned between the outer member and the inner lining and extends across an instep portion of the inner lining. The lace is coupled to the instep member and to the outer member. Applying a tension force to the lace causes the instep member to apply a force against the instep portion of the inner lining.

A further aspect of the invention relates to a footwear that includes an outer member, an inner lining, an instep member, and a tensioning member. The outer member defines an outer surface of the footwear. The inner lining is positioned within the outer member. The instep member is positioned between the outer member and the inner lining and extends across an instep portion of the inner lining. The tensioning member is coupled to the instep member and is configured to engage the instep portion of the inner lining when a tension force is applied to the instep member. A tension force against the inner lining results in a force being applied to an instep portion of a user's foot positioned in the footwear to hold the user's foot against a bottom and rear portion of the footwear.

A still further aspect of the invention relates to a slip-on boot that includes a sole, an outer member, an inner lining, an instep member, and a tensioning member. The outer member is coupled to the sole and defines an upper portion associated with a lower leg of a user and a lower portion associated with a foot of the user. The inner lining is positioned within the outer member and includes an instep portion associated with an instep of the user. The instep of the user is defined as the prominent area above the arch and the highest point on a user's foot. The instep member is positioned between the outer member and the inner lining, or embedded within the inner lining. The tensioning member is configured to apply a force to the instep member to tighten the instep member against the instep portion of the inner lining and the instep of the user.

Another aspect of the invention relates to a method of using a footwear. The method includes providing a footwear that includes a tensioning system having an instep member arranged within the footwear and a lace coupled to the instep member. The method also includes inserting a user's foot into the footwear and tensioning the lace to move the instep member against an instep of the user's foot. In some embodiments, the footwear is a slip-on boot void of fasteners or laces exposed on an exterior of the boot with exception of those portions of the lace that are exposed for applying a tension force to the lace. Tensioning the lace includes applying a force to the instep member in a direction toward a sole of the footwear.

The above summary of the present invention is not intended to describe each disclosed embodiment or every implementation of the present invention. Figures in the detailed description that follow more particularly exemplify certain embodiments of the invention. While certain embodiments will be illustrated and describe embodiments of the invention, the invention is not limited to use in such embodiments.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Several example tightening or tensioning systems for use in a footwear are disclosed herein after. The example systems include an instep member that is positioned within a footwear at a location corresponding with the instep of a user's foot when the user's foot is inserted in the footwear. The instep is defined as the upper top surface of a foot. The instep can also include the top and forward facing surfaces of the leg at the junction between the vertically oriented lower leg and the generally horizontal top surface of the foot. The system includes laces that are used to pull the instep member against the instep of the user's foot to help hold the user's foot against the bottom and rear interior surfaces of the footwear. By holding the user's foot in this way within the footwear, there can be greater stability for the user during use of the footwear.

The laces of the system are coupled to opposing sides/ends of the instep member that are positioned at opposing sides of the user's foot. The laces extend from the instep member generally downward and rearward in the footwear to a connecting or anchor point along a bottom side edge and/or at a rear portion of the footwear. The laces extend from the anchor point in a generally vertical direction and protrude out of the footwear at some point vertically above the anchor point for grasping by the user. The user can apply a tension force to the laces that in turn applies an instep force via the instep member onto the instep of the user's foot. The laces, when in the tightened state upon application of the tension force, can be locked in place to maintain the tension force in the laces and the resulting instep force applied by the instep member. The laces can also be released to release the tension and instep forces so that the user can more easily remove their foot from the footwear.

Figure 1:
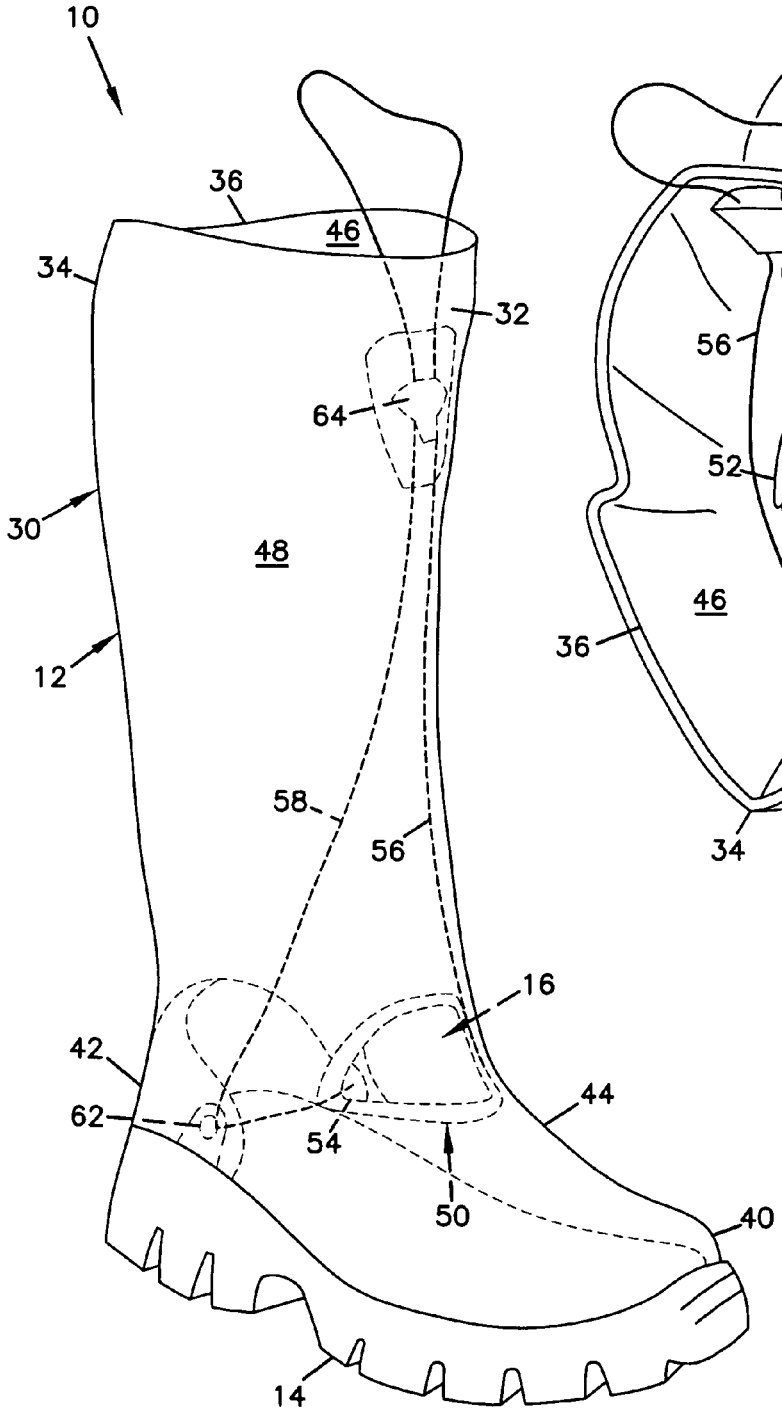
FIG. 1 is a front perspective view of an example footwear including an example tensioning system according to principles of the invention.
Figure 2:
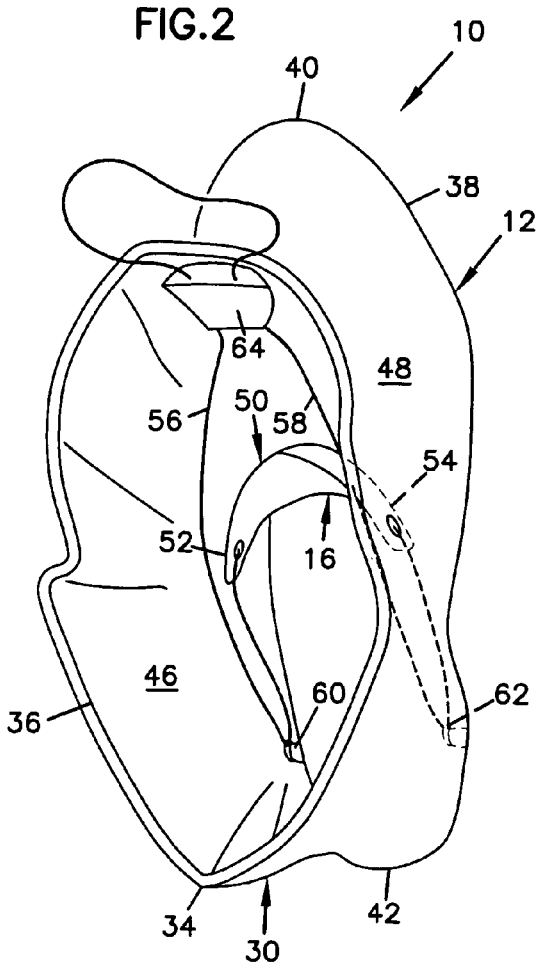
FIG. 2 is a top perspective view of the footwear shown in FIG. 1.

Referring now to FIGS. 1 and 2, an example footwear 10 is illustrated including an outer portion 12, a sole 14, and a tensioning system 16. The outer member 12 includes an upper portion 30 defining front and rear surfaces 32, 34, and a lower portion 38 that defines a toe, heel, and instep portions 40, 42, 44. The outer member 12 also includes an inside surface 46, an outside surface 48, and a top opening 36 defined in the upper 30 into which the user's foot and leg can be inserted.

The tensioning system 16 includes an instep member 50 having opposing sides 52, 54 aligned along opposing sides of the footwear 10. The tensioning system 16 also includes first and second laces 56, 58 attached to the opposing sides 52, 54 that extend through respective first and second anchors 60, 62. The laces further extend vertically from the anchors 60, 62 towards the top opening 36 of the outer member 12 where the laces are exposed for applying a tension force to the laces. A lock 64 is positioned along the length of the laces between the anchor 60, 62 and the top opening 36. The lock 64 can function automatically or manually to apply a locking and unlocking function to the laces. In a locked position, the lock fixes the laces in an extended position with a tension force applied to the laces that results in an instep force being applied via the instep member 50. In an unlocked position, the laces are released so that the tension force and instep force are released to loosen the instep member 50.

Figure 3:
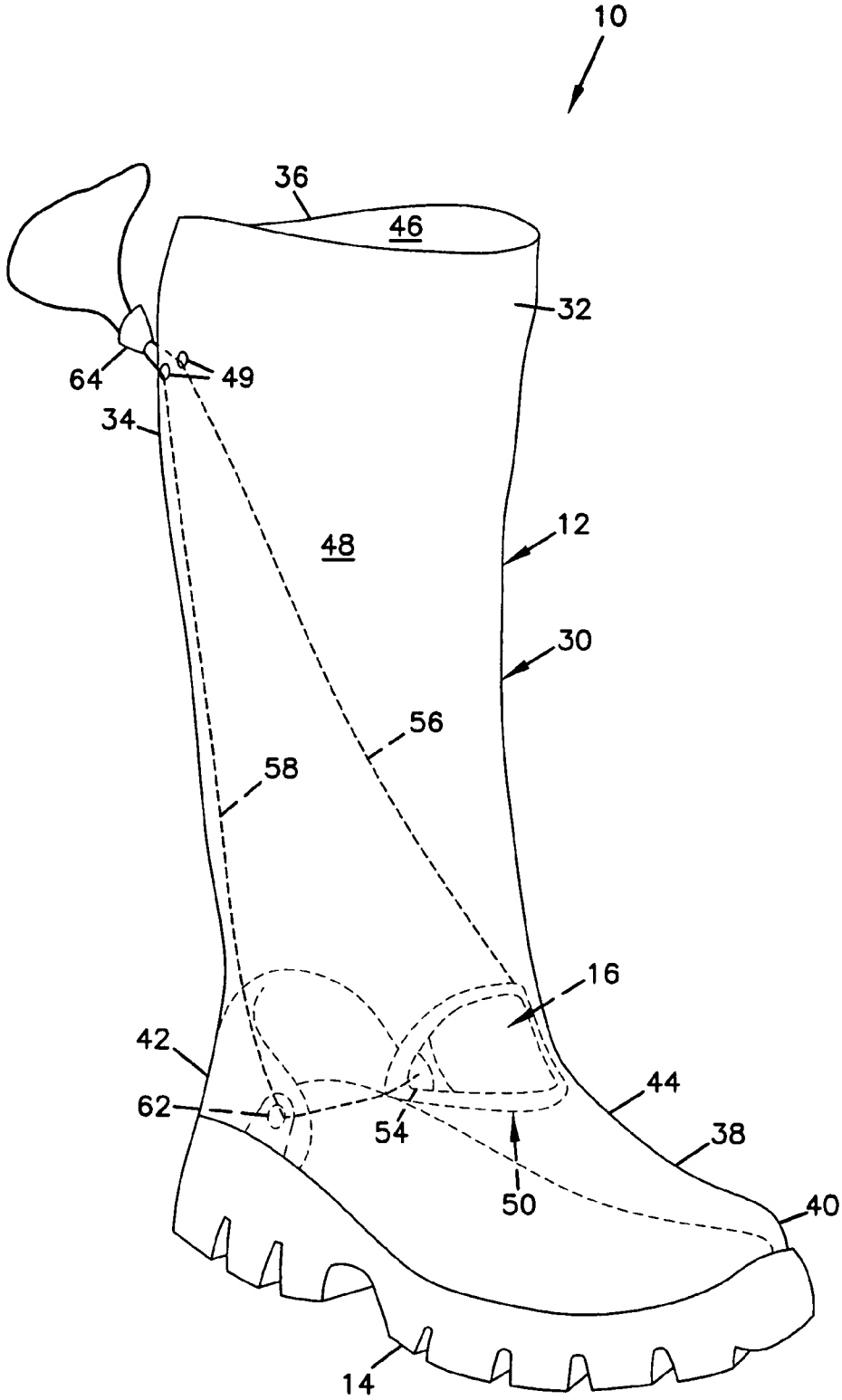
FIG. 3 is a front perspective view of the footwear shown in FIG. 1 including another example tensioning system according to the invention.

The footwear 10 shown in FIGS. 1 and 2 provide for the laces 52, 54 to extend from the anchor 60, 62 vertically upward along the front side 32 of the upper 30 adjacent to the interior surface 46. This arrangement provides for exposure of the laces along the front side 32 of the footwear 10 for operation by a user. This arrangement provides for the laces to be accessible for operation by a user along the rear side of the footwear 10. FIG. 3 further illustrates the footwear 10 including lace openings 49 along the rear surface 34 at a location on the upper 32 between the anchor 60, 62 and the opening 36. The lace openings 49 can position at any location along the rear surface 34. The position of the lace openings 49 provide slight variations in the performance of the tensioning system 16. The position of the lace openings 49 can affect the angle of tension from the anchors 60, 62.

The instep member 50 of the tensioning system 16 is positioned along the instep 44 of the outer member 12. The instep member 50 is configured to extend across the instep of a user's foot positioned within the footwear 10. As discussed above, slip-on footwear such as the footwear 10 shown in FIGS. 1-3 typically does not include structure that provides tightening of the footwear around the user's foot. As a result, the user's foot is able to shift within and even come out of the footwear during use. The tensioning system 16 uses the laces 52, 54 that are anchored at the anchoring members 60, 62 to apply a force onto the instep portion of the user's foot using the instep member 50. The application of this instep force via the instep member 50 to the instep of the user's foot can be maintained by locking the laces 52, 54 in a locked position using the lock 64. In this way, the user's foot can be firmly held against the sole 14 and the rear 34 as well as the heel portion 42. This arrangement provides for greater stability of the footwear during use.

Many types of footwear include an additional inner lining position within the outer member 12. The use of an inner lining may be advantageous with the footwear 10 shown in FIGS. 1-3 in order to isolate portions of the tensioning system, in particular the laces 52, 54 and anchoring members 60, 62, from direct contact with the user's foot. If the tensioning system 16 were exposed within the footwear, the user's foot may become entangled in these features when inserting or removing the user's foot from the footwear 10. Thus, an inner lining can be useful for improved ease of use of the footwear 10.

Figure 4:
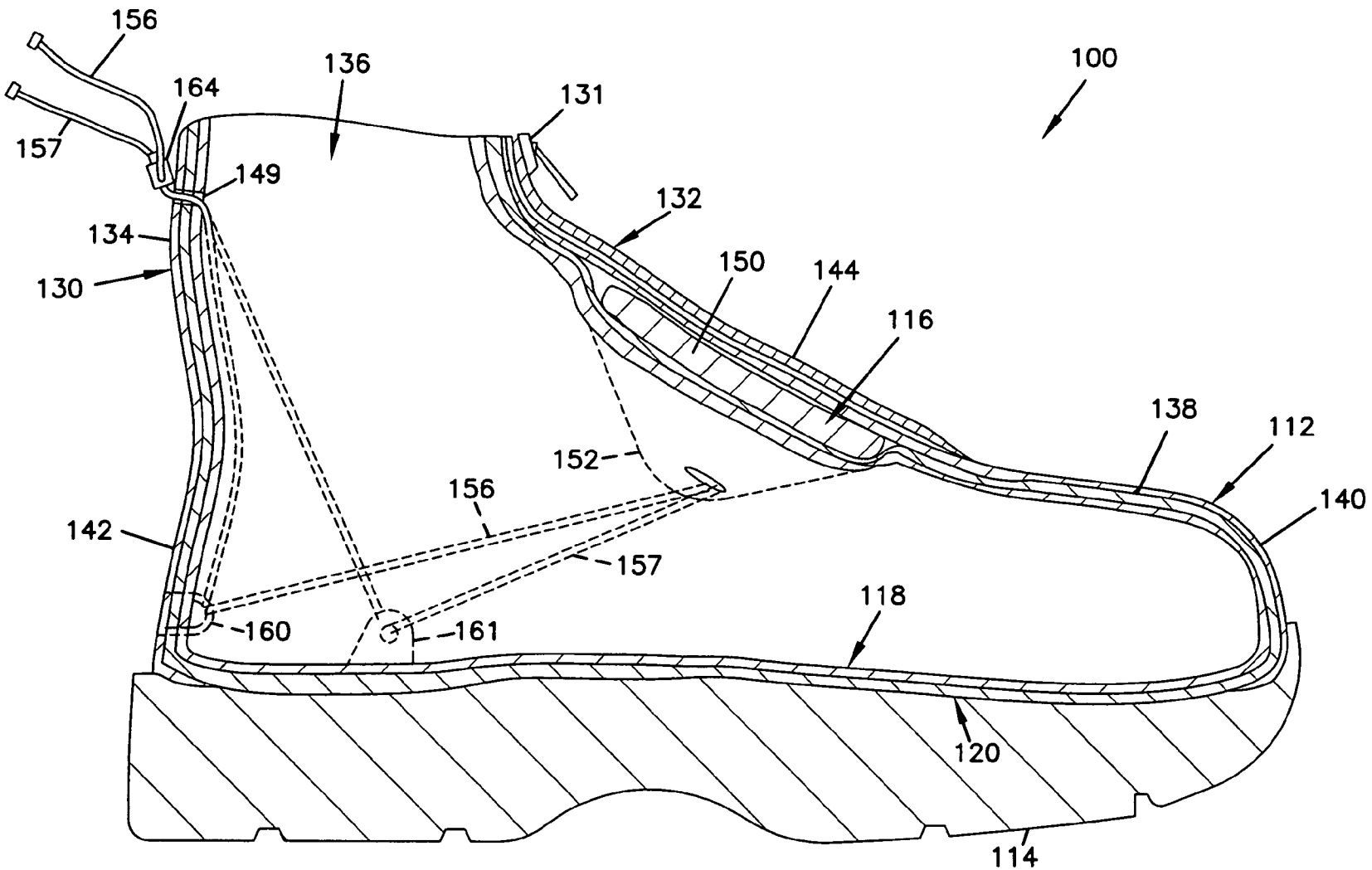
FIG. 4 is a cross-sectional view of an example footwear including another example tensioning system according to the invention.
Figure 5:
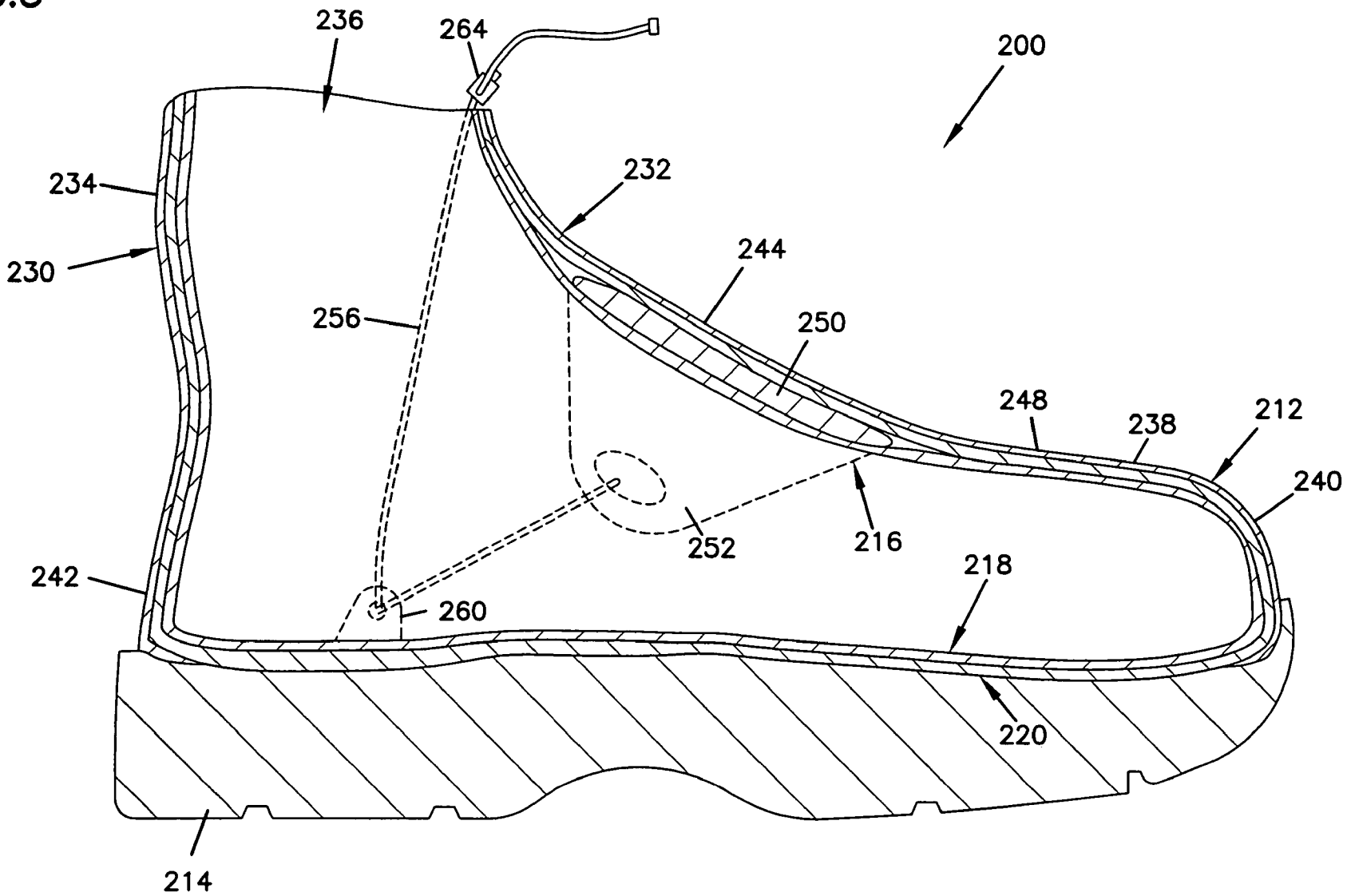
FIG. 5 is a cross-sectional view of another example footwear including another tensioning system according to the invention.

FIGS. 4 and 5 illustrate two alternative footwear embodiments that include multiple lining members within the outer member of the footwear. FIG. 4 illustrates footwear 100 having an outer member 112, a sole 114, a tensioning system 116, an inner lining 118, and an intermediate lining 120 that is positioned between the inner lining 118 and the outer 112. The tensioning system 116 encapsulated between the outer 112 and the intermediate lining 120 except for that portion of the laces that is exposed outside of the footwear of the outer member 112 for applying tension force to the laces. The inner and intermediate linings may have specific properties such as, for example, being waterproof, odor absorbent, and insulated.

The outer member 112 includes an upper portion 130 having front and rear surfaces 132, 134, a top opening 136, and a lower portion 138 that defines toe, heel, and instep portions 140, 142, 144. The outer 112 also includes lace openings 149 along the rear surface 134 that pass through the inner and intermediate linings 118, 120.

The tensioning system 116 includes an instep member 150 having opposing sides (side 152 being illustrated), laces (first lace 156 being shown), and anchors (first anchor 160 being shown). The tensioning system 116 also includes a lock 164 positioned along the length of laces outside of the outer member 112 to help hold the tension force in the laces or release the laces so as to release the instep member 150.

The footwear 100 also includes a zipper closure 131 along the front surface 132 of the outer member 112. The zipper closure provides for opening up of the footwear 100 across the front surface 132 to improve ease of inserting the user's foot into the opening 136. In use, the zipper closure 131 may not provide sufficient tensioning forces against the user's foot after it has been inserted into the footwear 100. The tensioning system 116 can apply additional tensioning forces across the instep of the user's foot thereby providing the desired tensioning and improved stability for the user's foot in the footwear 100.

The anchors 160 of the tensioning system 116 is shown secured to the heel portion 142 of the outer member 112. The location of the anchors is preferably at some location vertically below the instep member 150. In other embodiments such as shown in FIGS. 1-3, the anchor may be positioned along the sides of the outer member 112 adjacent to the sole 114 and closer proximity to the instep member 150. By varying the angle between the instep member 150 and the anchor 160, different types of instep forces can be applied to the user's foot.

In some embodiments, additional sets of laces such as lace 157 can be added to the tensioning system 116 and coupled at anchor 161 to apply instep forces at an alternative angle due to the change in location of the anchor 161. In still further embodiments, the additional lace 157 may extend to different locations in the footwear such as to the front surface 132 rather to the rear surface 134 as shown. It is contemplated that the tensioning system 116 may include any number of laces, anchors and orientation of those members relative to the instep member 150 and to the front and rear surfaces or even to opposing side surfaces on opposing inside and outside sides of the footwear outer member 112.

FIG. 5 illustrates a footwear 200 having an outer member 212, a sole 214, a tensioning system 216, an inner lining 218, and an intermediate lining 220. The outer member 212 includes an upper 230 having front and rear surfaces 232, 234, a top opening 236, and a lower member 238 having toe, heel and instep portions 240, 242, 244. The outer member 212 also includes an inner surface 246 and an outer surface 248.

The tensioning system 216 includes an instep member 250 having opposing sides (opposing side 252 shown), laces (a first lace 256 shown), anchoring members (a first anchoring member 260 shown), and a lock 264. The anchor 260 is positioned along a bottom interior surface of the outer member 212 at a location between the heel 242 and the toe 240. The lace 256 extends toward the top opening 236 along the front surface 232 where it is exposed for grasping by a user to apply tension force to the lace.

The instep member 250 is positioned between the inner lining 218 and the intermediate lining 220. Positioning the instep member in this manner may have certain advantages related to such issues as, for example, comfort for the user, and wear of the waterproof layer. Some types of material used for the intermediate layer have a sensitive outer surface that is treated and structured to provide optimum waterproofing capabilities. In some circumstances, positioning the instep member in direct contact with the outer exposed surface of the waterproof layer can result in wear of the outer surface that results in depletion of the waterproofing properties of the waterproof lining. Therefore, in some instances it may be advantageous to position the instep member 250 between the inner lining and the waterproofing layer and the outer member as shown in FIG. 4.

In other embodiments, the footwear may not include the intermediate lining such that the instep member is positioned in contact with an outer surface of the inner lining and the inner surface of the outer member.

Further, in some embodiments, the inner lining and intermediate lining 218, 220 shown in FIG. 5 may be interchanged so that the intermediate lining is exposed to the user's foot within the footwear and the inner lining is positioned between the outer member and the intermediate lining. In still further embodiments, the instep member may be integrated into a lining member rather than being a separate piece from the lining. In still further embodiments, the instep member can be attached to one or more of the liners such that the liner moves in tandem with any movements or adjustments of the instep member in still further embodiments, the instep member may be connected to an internal surface of the outer member of the footwear such that tightening the instep member has the effect of pulling the instep portion of the outer member against the user's foot in addition to the instep member itself applying the instep force against the user's foot.

Figure 6:
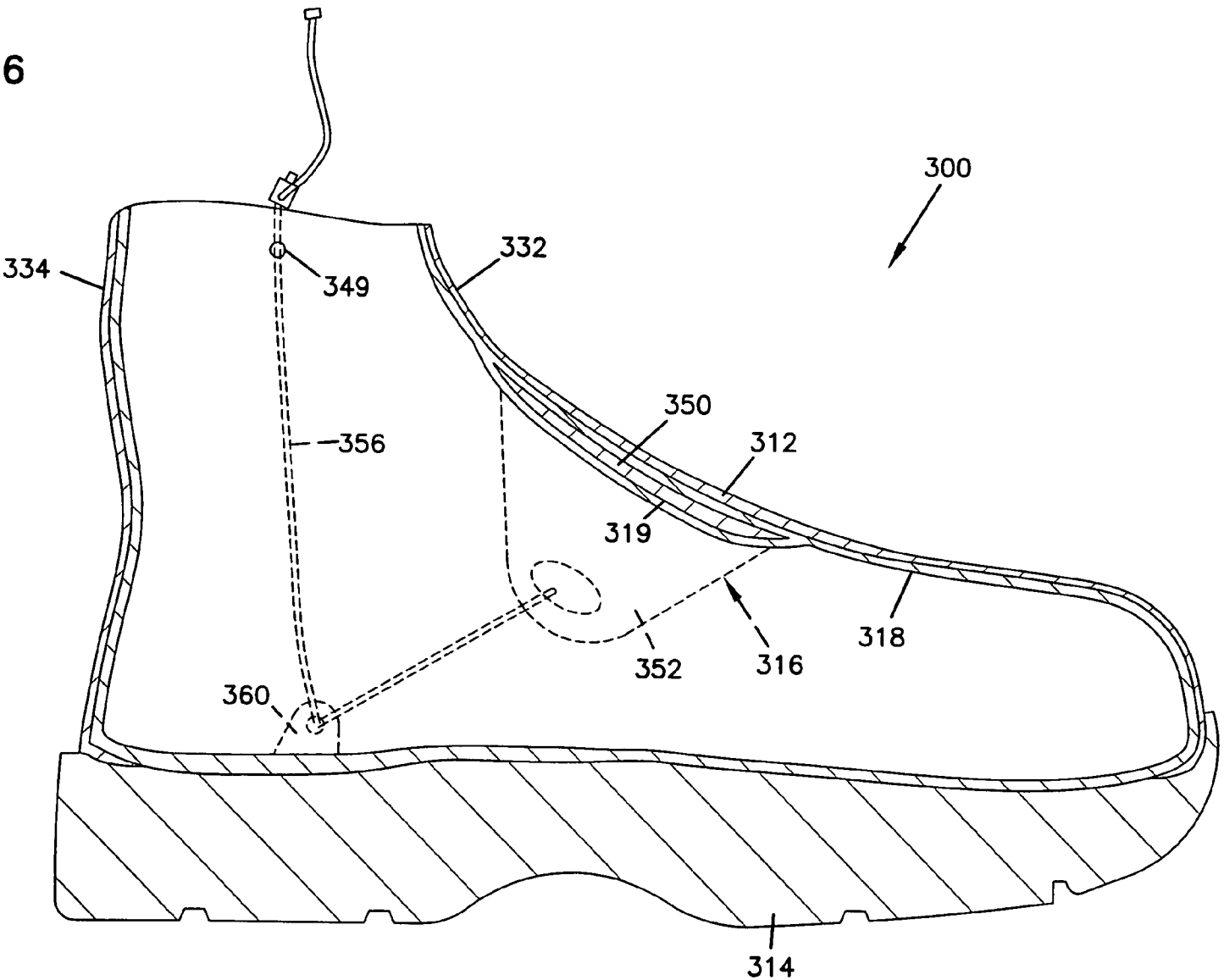
FIG. 6 is a cross-sectional view of another example footwear including another tensioning system according to the invention.

Referring now to FIG. 6, another example footwear 300 is shown having an outer member 312, a sole 314, a tensioning system 316, and an inner lining 318. The tensioning system 316 includes an instep member 350 having opposing sides (opposing side 352 shown), laces (a first lace 356 shown), anchoring members (a first anchoring member 360 shown), and a lock 364. The lace 356 extends vertically upward in the footwear 300 where it protrudes out of a lace opening 349 in a sidewall of the footwear between front and rear oriented surfaces 332, 334 of the footwear where the lace 356 is exposed for grasping by a user to apply tension force to the lace.

The instep member 350 is positioned within a pocket 319 defined by the inner lining 318. The pocket 319 may be cavity defined in the inner lining into which the instep member is inserted. The pocket 319 can also be defined concurrently with embedding of the instep member in the liner, for example, if the inner lining is formed around the instep member. Positioning the instep member in a pocket can help retain the instep member in correct orientation relative to a user's foot positioned in the footwear 300. Positioning the instep member in a pocket can also help maintain contact between the instep member and the liner thereby minimizing abrasion and wear that could occur if movement occurs between the instep member and liner. The liner 318 can include a section of material in the area that defines the pocket 319 that is more flexible than other portions of the liner. Increased flexibility in the pocket 319 and that portion of the liner 318 surrounding the pocket can improve movement of the liner with the instep member when tension forces are applied to the instep member by the laces 356.

Figure 7:
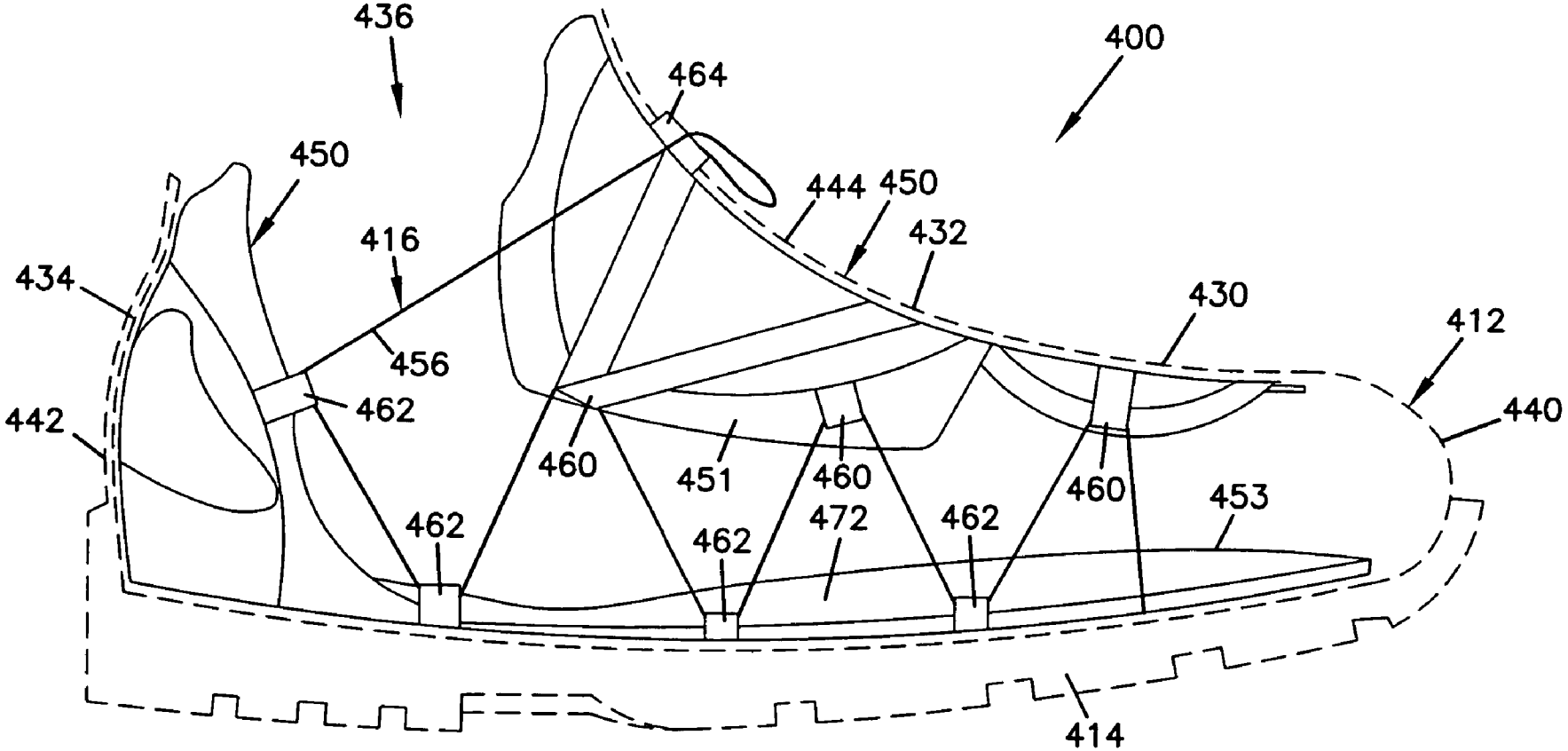
FIG. 7 is a side view of another example footwear including another example tensioning system according to the invention.

Referring now to FIG. 7, another example footwear 400 is shown. The footwear 400 includes an outer 412 (shown in phantom line) a sole 414 (shown in phantom line), and a tensioning system 416. The outer 412 includes a lower portion 438 having front and rear surfaces 432, 434, a top opening 436, and toe, heel and instep portions 440, 442, 444. The footwear 400 is configured as an athletic shoe such as a running shoe. However, principles illustrated with respect to footwear 400 can be applied in other types and styles of footwear such as casual footwear or boots.

The tensioning system 416 includes an instep member 450 having an upper portion 451 and a lower portion 453, a lace 456, upper and lower anchors 460, 462, and a lock 464. The upper portion 451 of the instep member 450 includes a plurality of the anchors 460 positioned along its length. The lower portion 453 of the instep member 450 includes a plurality of lower anchors 462 along its length. The lace is interwoven back and forth between the upper and lower anchors and is tightened at the front surface 432 of the footwear. By tightening the lace and locking it in position with the lock 464, a tensioning force can be applied along the length of the footwear such that an instep force is applied to the user's foot via the upper portion 451. The position of the anchoring members along the top and bottom portions of the instep member 450 can provide for application of instep forces at specific locations to provide the desired support in the footwear 400. The lace 456 can be exposed at any desired location such as, for example, out the rear surface 434 rather than out the front surface 432. In still further embodiments, multiple lace members may be used along opposing inside and outside side surfaces of the footwear wherein each lace has differing anchor points and may be exposed to a variety of locations for applying a tension force to the lace.

The footwear 400 includes the tensioning system 416 positioned interior of the outer member 412. The tensioning system may be exposed within the footwear for direct contact with the user's foot that has been inserted through the top opening 436. In some embodiments, an additional inner lining may be positioned within the footwear between the tensioning system 416 and the user's foot. In this arrangement, the tensioning system 416 would be positioned between the inner lining and the outer member 412.

In other embodiments (not shown) the tensioning systems of the example footwear shown in FIGS. 1-7 may be used in combination with exterior tensioning systems such as laces, straps, velcro strips or the like that are positioned on an exterior surface of the outer member of the footwear. This combination of internal and external tensioning systems can provide alternatives for the user to apply a desired amount of tension on the user's foot at the instep or other locations. The tensioning systems disclosed herein are not limited to applications for slip on footwear only, but can be used with other types of footwear that have separate external tensioning systems.

The lock shown in FIGS. 1-7 should be capable of maintaining the tension force in the laces until such time as the user of the footwear would like to release the instep force being applied by the instep member. Different locks can be used to maintain this force while still providing capabilities for release of that tension force for easy adjustment and/or removal of the user's foot from the footwear.

Figure 8:
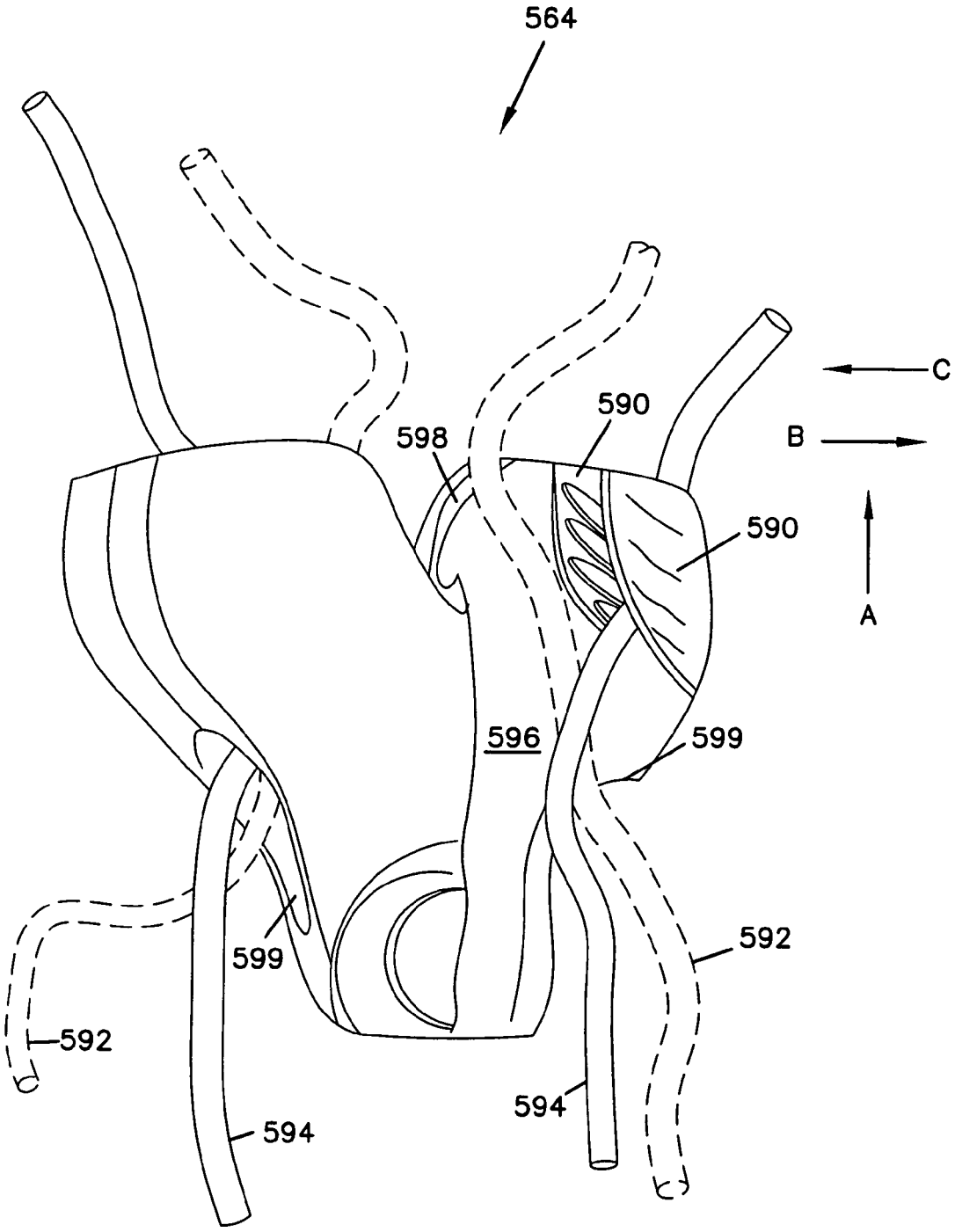
FIG. 8 is a front perspective view of an example lock for use with the tensioning systems shown in FIGS. 1-7.

FIG. 8 illustrates an example lock 564 that includes clamping members 590, laces shown in a loosening position 592, laces shown in a secured position 594, an interior 596, an open top 598, and bottom openings 599. The lock 564 is able to lock the loose laces 592 into a secured position by pulling the laces vertically upward in the direction A and pulling the laces outward laterally in the direction B to lock them within the clamping members 590. The laces 594 in the secured position can be released by again pulling the laces in the direction A and then moving the laces laterally in the direction C so that they are removed from the clamping members 590. This allows the laces to be released in a direction opposite to the direction A out of the bottom openings 599.

Other types of locks can be used that include moving features that are manually moved between locking and released positions for locking and unlocking the laces.

The laces described above with reference to FIGS. 1-8 can also be referred to as laces, elongate straps, ties, etc. The laces shown in FIGS. 1-8 can have a circular or rectangular cross-section. However, other types of laces can be used wherein the laces have different cross-sectional shapes such as rectangular or generally flat straps. The laces can comprise any desired material having the strength and durability properties necessary for repeated use and resistance to failure. One type of material that may be particularly advantageous is a material comprising Teflon or other high strength, wear resistant synthetic material.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A footwear, comprising:

a sole configured to engage a ground surface;

an outer member defining an outer surface of the footwear, the outer member including:

a lower portion connected to the sole, the lower portion configured to receive at least a portion of a person's foot;

an upper portion connected above the lower portion, the upper portion including an upper opening configured to loosely receive a portion of a person's leg, the upper opening including a continuous upper peripheral edge having a constant length;

an inner lining positioned within the outer member;

an instep member positioned between the outer member and the inner lining, the instep member extending across at least a portion of the instep portion of the inner lining; and a lace directly connected to the instep member and connected to the outer member, wherein applying a tension force to the lace causes the instep member to apply a force against the instep portion of the inner lining and wherein the upper opening remains loosely fit around a portion of a person's leg.

2. The footwear of claim 1, wherein the lace is coupled at an anchor point to a heel portion of the outer member, and applying the tension force to the lace moves the instep member towards the heel portion.

3. The footwear of claim 2, wherein the lace extends from the anchor point at the heel portion into the upper portion where the lace is exposed.

4. The footwear of claim 3, wherein an end of the lace extends through the outer member at the upper portion.

5. The footwear of claim 3, wherein the upper portion defines a front portion and a rear portion associated with a front and rear portion of a user's leg, and a portion of the lace is exposed at the front portion.

6. The footwear of claim 3, wherein the upper portion defines a front portion and a rear portion associated with a front and rear portion of a user's leg, and a portion of the lace is exposed at the rear portion.

7. The footwear of claim 1, further comprising an intermediate lining positioned between the inner lining and the outer member, wherein the instep member is positioned between the intermediate lining and the inner lining.

8. The footwear of claim 1, further comprising an intermediate lining having water resistant properties positioned between the inner lining and the outer member, wherein the instep member is positioned between the intermediate lining and the outer member.

9. The footwear of claim 1, wherein the lace is coupled to the instep member at opposing sides of the instep member associated with opposing sides of the inner lining.

10. The footwear of claim 1, further comprising a clamp arranged and configured to retain the tension force in the lace.

11. The footwear of claim 1, wherein the lace tensioning member is connected to the outer member at a location on the footwear vertically lower than a position of the instep member.

12. The footwear of claim 1, wherein the upper portion is void of laces across a front oriented surface of the boot.

13. The footwear of claim 1, further comprising a lock configured to retain a tension force in the lace.

14. The footwear of claim 1, wherein the lace is connected to the instep member in a manner that allows the lace to move relative to the instep member.

* * * * *